United States Patent [19]

Sterzel

[11] Patent Number: 4,645,819

[45] Date of Patent: Feb. 24, 1987

[54] NON-CROSSLINKED POLYETHER-KETONES WHICH CAN BE PROCESSED BY A THERMOPLASTIC METHOD, AND THEIR PREPARATION

[75] Inventor: Hans-Josef Sterzel, Dannstadt-Schauernheim, Fed. Rep. of Germany

[73] Assignee: BASF Aktiengesellschaft, Fed. Rep. of Germany

[21] Appl. No.: 727,135

[22] Filed: Apr. 25, 1985

[30] Foreign Application Priority Data

May 4, 1984 [DE] Fed. Rep. of Germany ..... 3416455

[51] Int. Cl.[4] ..... C08G 8/02; C08G 14/00

[52] U.S. Cl. ..... 528/125; 528/126; 528/128; 528/190; 528/191

[58] Field of Search ..... 528/125, 126, 128, 190, 528/191

[56] References Cited

U.S. PATENT DOCUMENTS

| | | | |
|---|---|---|---|
| 3,065,205 | 11/1962 | Bonner, Jr. | 528/190 |
| 3,385,825 | 5/1968 | Goodman et al. | 260/61 |
| 3,441,538 | 4/1969 | Marks | 260/49 |
| 3,516,966 | 6/1970 | Berr | 260/47 |
| 3,767,620 | 10/1973 | Angelo et al. | 528/125 |
| 3,956,240 | 5/1976 | Dahl et al. | 260/47 |
| 4,396,755 | 8/1983 | Rose | 528/126 |
| 4,398,020 | 8/1983 | Rose . | |

FOREIGN PATENT DOCUMENTS

| | | | |
|---|---|---|---|
| 2433278 | 8/1964 | Fed. Rep. of Germany . | |
| 971227 | 9/1964 | United Kingdom | 528/125 |
| 1164817 | 9/1969 | United Kingdom . | |

*Primary Examiner*—Lucille M. Phynes

*Attorney, Agent, or Firm*—Keil & Weinkauf

[57] ABSTRACT

Polyether-ketones containing the structural unit

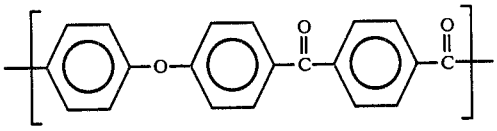

have a completely linear structure, and are heat-stable and free from crosslinking reactions during processing at from 390° to 420° C.

They are prepared by Friedel-Crafts acylation of terephthaloyl chloride or terephthaloyl fluoride with diphenyl ether in hydrogen fluoride as a solvent and with boron trifluoride as a catalyst, the polycondensation reaction being carried out by a method in which the reaction mixture is a homogeneous solution.

4 Claims, No Drawings

NON-CROSSLINKED POLYETHER-KETONES WHICH CAN BE PROCESSED BY A THERMOPLASTIC METHOD, AND THEIR PREPARATION

Aromatic polyether-ketones which consist only of p-phenylene rings bridged by oxygen and carbonyl groups are a class of plastics which possess very good properties. They are highly heat-stable and self-extinguishing, produce little smoke when flamed, are very rigid and possess high impact strength. Because of their high crystallinity, they are extremely resistant to solvents and to stress cracking.

They can be processed oy the conventional thermoplastic techniques, i.e. by injection molding, extruding, blow molding, etc., to give snaped articles, films, hollow moldings or profiles.

Because of their outstanding combinations of properties, aromatic polyether-ketones are also becoming increasingly important as wire enamels or wire and cable coverings or, in combination with very rigid and/or very strong reinforcing fibers, as a thermoplastic matrix in high-performance reinforced materials.

According to U.S. Pat. No. 3,344,538, polyether-ketones are prepared by Friedel-Crafts acylation in hydrogen fluoride as a solvent and with boron trifluoride as a catalyst. In this procedure, the economically available monomers diphenyl ether and terephthaloyl chloride are reacted to form a high molecular weight polyether-ketone of the structure

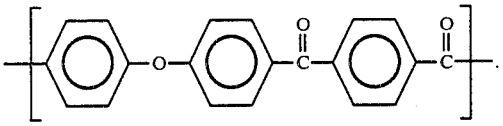

I

The polyether-ketone prepared in this manner has a crystallite melting point of about 385° C. measured by the DSC method at a heating rate of 32° C./min. Thermoplastic processing of the polyether-ketone is possible only above the crystallite melting point, and is preferably carried out at from 390° to 420° C. However, when processing is effected under these temperature conditions, the polymer is found to have a very pronounced tendency to undergo crosslinking, this tendency leading to an undesirable increase in the melt viscosity and to extrudates having a rough surface and poor toughness. When the solution viscosity is determined in concentrated sulfuric acid, it is found that the extruded polymer only dissolves partially since crosslinked gel particles have formed.

According to U.S. Pat. No. 3,516,966, the tendency of this polyether-ketone to undergo crosslinking is inherent in the structure. It has therefore been proposed that as much as 30 mol % of the terephthaloyl chloride be replaced by isophthaloyl chloride in the preparation of the polyether-ketone I. Although this results in a decrease in the crystallite melting point and hence in the processing temperature, it reduces the crystallinity of the polyetherketones, having a very disadvantageous effect on their resistance to solvents and to stress cracking. For example, a copolymer containing only 10% of isophthaloyl units is soluble in dichloroacetic acid.

It is an object of the present invention to prepare high quality aromatic polyether-ketones based on the economically available monomers terephthaloyl chloride and diphenyl ether.

According to U.S. Pat. No. 3,441,538, the polycondensation is carried out using boron-trifluoride as a Friedel-Crafts catalyst, preferably in not less than an equimolar amount, based on the acyl halide groups of the monomers. The polycondensation is effected in hydrogen fluoride, which is required as a solvent for the polymer formed. Moreover, the terephthaloyl chloride is converted in a preliminary stage with the hydrogen fluoride to the more reactive compound terephthaloyl fluoride.

The molar ratio of terephthaloyl chloride to diphenyl ether is preferably from 1:0.9 to 1:1.1, in particular from 1:1.01 to 1:1.05. The molecular weight of the polymer can be regulated by means of a small excess of a reactant, preferably diphenyl ether.

In the prior art method, the monomers and the total amount of hydrogen fluoride and boron trifluoride are combined simultaneously. Consequently, the reaction takes place in a two-phase system, since diphenyl ether is insoluble in hydrogen fluoride, particularly in the presence of large amounts of boron trifluoride (Example 7 of U.S. Pat. No. 3,441,538).

I have found that this object is achieved, and that, surprisingly and in contradiction to U.S. Pat. No. 3,516,966, high molecular weight polyether-ketones which have intrinsic viscosities of from 0.4 to 1.6, measured in concentrated sulfuric acid, and do not crosslink at from 400° to 420° C. are obtained from terephthaloyl chloride and diphenyl ether if the polycondensation reaction is carried out in the homogeneous phase.

This condition can be satisfied by two versions of the process. In the first version, terephthaloyl chloride and diphenyl ether are first mixed, and an inert solvent, preferably nitromethane, is then added. The weight ratio of terephthaloyl chloride and diphenyl ether together to the solvent is preferably from 1:0.5 to 1:1.5. The amount of inert solvent is such that the diphenyl ether remains completely in solution.

Hydrogen fluoride is then added in an amount such that the terephthaloyl chloride is certain to be converted to terephthaloyl fluoride. Not less than 2, preferably from 3 to 5, moles of hydrogen fluoride are required per mole of terephthaloyl chloride.

The reaction mixture is then cooled to temperatures of from −15° to −25° C., and boron trifluoride is passed in at this temperature in an amount such that a conversion of from 50 to 85% based on polymer, is achieved. The addition of boron trifluoride is then interrupted, and hydrogen fluoride is metered in so that a polymer solution containing from 30 to 45% of polyether-ketone is formed.

The introduction of boron trifluoride is then continued, and the temperature is increased to 0° to +5° C. in the course of from 1 to 3 h. The polycondensation is continued at this temperature until the desired viscosity is reached.

This procedure ensures that the reactiqn takes place constantly in a homogeneous phase, apart from the presence of the gaseous boron trifluoride.

In another preferred version of the process, the single-phase polycondensation is carried out without the addition of an inert solvent, which may be troublesome during subsequent working up of the reaction solution.

To carry out this procedure, hydrogen fluoride is added to the mixture of terephthaloyl chloride and diphenyl ether in an amount which is just sufficient to form terephthaloyl fluoride and so that just sufficient excess hydrogen fluoride is present to keep the mixture of terephthaloyl fluoride and diphenyl ether in homogenous solution at from −10° to −20 C. From 6 to 8 moles of hydrogen fluoride per mole of terephthaloyl chloride used are required for this purpose. The mixture is then cooled to a temperature of from −10° to −20° C., and boron trifluoride is passed in until a conversion of from 50 to 85%, based on polymer, is achieved. Thereaftar, the remaining amount of hydrogen fluoride required to obtain a solution containing from 30 to 45% by weight of polyether-ketone is added. Further boron trifluoride is passed in while the temperature is increased to 0°–5° C. in the course of from 2 to 3 h, and the polycondensation is continued at this tamperature until the desired viscosity is reached.

In both cases, the molar ratio of terephthaloyl chloride to diphenyl ether is preferably from 1:0.9 to 1:1.1, in particular from 1:1.01 to 1:1.05. The molecular weight of the polymer can be regulated by means of a small excess of a reactant, preferably diphenyl ether. The molar ratio of hydrogen fluoride to terephthaloyl chloride should be less than 10:1 at the beginning of the polycondensation reaction; in the course of the reaction, hydrogen fluoride should then be added in an amount such that a 20–50% strength by weight solution of the polyether-ketone in hydrogen fluoride is subsequently obtained. The temperature in the course of the polycondensation reaction should not exceed +10° C. since otherwise crosslinking may occur.

The polyether-ketone is isolated by precipitation in water and, in order to remove hydrogen fluoride and boron trifluoride, is extracted several times with polar solvents and/or water until the contents of boron and fluoride are below 10 ppm.

EXAMPLE 1

203 g (1 mole) of terephthaloyl chloride, 173.4 g (1.02 mole) of diphenyl ether and 150 g of nitromethane were initially taken at 20° C. in a 1.4 liter ®Hastelloy C stirred vessel equipped with a double jacket for thermostatting, a temperature-measuring apparatus, a temperature regulating apparatus, a stirrer, a means for measuring viscosity via the stirrer torque, and a Hastelloy C reflux condenser. 80 g (4 moles) of anhydrous hydrogen fluoride were then fed in. Terephthaloyl fluoride was formed immediately with evolution of hydrogen chloride and cooling to −8° C. After about half an hour, during which the temperature was allowed to increase to +5° C., the evolution of hydrogen chloride was complete. The reaction mixture was cooled to −20° C. and 105 g of boron trifluoride (77% conversion) was passed into the stirred mixture, the temperature being kept at from −15° to −20° C. A further 400 g of anhydrous hydrogen fluoride were then metered in, and the introduction of boron trifluoride was continued.

At the same time, the temperature was increased to +2° C. in the course of 2 h, and stirring was continued for 7 h with further passage of boron trifluoride (about 5 g/h) and with boron trifluoride under slightly superatmospheric pressure of 0.2 bar, the viscosity of the solution increasing sharply and then remaining constant.

The viscous orange-red polymer solution was forced through a nozzle in the bottom of the stirred vessel, by means of nitrogen, into a water bath, where it immediately coagulated. The resulting extrudate was purified by extraction with hot (90° C.) water and then granulated and dried. The intrinsic viscosity of the polyether-ketone was 1.01, measured in concentrated sulfuric acid at 25° C. After being heated for 10 minutes at 415° C., it was converted to a smooth, tough extrudate using a capillary viscometer. When processing was complete, the intrinsic viscosity was 0.99, showing that the novel process gives a stable, non-crosslinked polyether-ketone.

EXAMPLE 2

In the experimental apparatus from Example 1, 140 g (7 moles) of anhydrous hydrogen fluoride were metered into a mixture of 203 g of terephthaloyl chloride and 173.4 g of diphenyl ether at 20° C.

The reaction mixture cooled to −10° C. as a rasult of the evolution of hydrogen chloride. After about three quarters of an hour, the evolution of gas was complete. The reaction solution was cooled to −15° C., and 95 g of boron trifluoride (70% conversion) were passed into the stirred mixture, the temperature being kept at −15° C. Thereafter, a further 460 g of anhydrous hydrogen fluoride were metered in, and the introduction of boron trifluoride was continued while the temperature was increased at the same time to +2° C. in the course of 2 hours. At 2° C., about 5 g/h of boron trifluoride under a superatmospheric pressure of 0.2 bar were passed into the stirred mixture. After about 7 h, a constant viscosity was obtained, and the polyether-ketone was isolated, purified, dried and tested, these operations being carried out as described in Example 1. The resulting polyether-ketone had an intrinsic viscosity of 1.05 in concentrated sulfuric acid and could be converted to a smooth, tough extrudate in a capillary viscometer after heating for 10 minutes at 415° C. After the extrusion, the intrinsic viscosity was 1.05.

EXAMPLE 3

(Comparative example from the prior art)

203 g of terephthaloyl chloride and 173.4 g of diphenyl ether were initially taken in the apparatus described in Example 1. 600 g of anhydrous hydrogen fluoride were fed in at 20° C., after which the temperature decreased to −3° C. with evolution of hydrogen chloride. After about three quarters of an hour, during which the reaction solution warmed up to +3° C., the solution was cooled to −15° C., and 136 g of boron trifluoride were passed in. During this procedure, it was difficult to keep the temperature at 15° C., presumably because of sporadic heat accumulation during the heterogeneous reaction. Further boron trifluoride (about 5 g/h) was passed in under a superatmospheric pressure of 0.2 bar and the temperature was increased to +2° C. in the course of 2 h, and stirring was continued for a further 7 h at this temperature. Compared with the examples according to the invention, the resulting solution was deeper red. The polyether-ketone was isolated from this solution as described above, and had an intrinsic viscosity of 0.82. During processing at 415° C., it gave a rough, brittle extrudate which was difficult to extrude. Owing to the formation of swollen particles, it was impossible to carry out a viscosity measurement of the extrudate.

I claim:

1. A polyether-ketone containing structural units of the formula

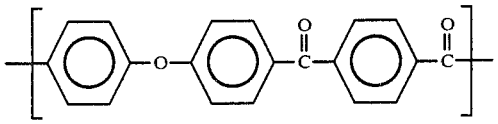

and having an intrinsic viscosity of from 0.4 to 1.6, measured in concentrated sulfuric acid at 25° C., which has a completely linear structure, and is heat-stable and free from crosslinking reactions during processing at from 390° to 420° C. said polyether ketone obtained by a polycondensation of terephthaloyl chloride or terephthaloyl fluoride with diphenyl ether in homogeneous phase at a reaction temperature not exceeding +10° C.

2. A process for the preparation of a polyether-ketone as claimed in claim 1 by Friedel-Crafts acylation of terephthaloyl chloride or terephthaloyl fluoride with diphenyl ether in hydrogen fluoride as a solvent and with boron trifluoride as a catalyst, wherein the reaction mixture is a homogeneous solution during the polycondensation reaction.

3. A process for the preparation of a polyether-ketone as claimed in claim 2, wherein an inert solvent, preferably nitromethane, is added in order to dissolve the diphenyl ether.

4. A process for the preparation of a polyether-ketone as claimed in claim 2, wherein the temperature does not exceed +10° C. in the course of the polycondensation reaction.

* * * * *